US009771764B2

(12) United States Patent
Millet et al.

(10) Patent No.: US 9,771,764 B2
(45) Date of Patent: Sep. 26, 2017

(54) TORQUE ANCHOR FOR BLOCKING THE ROTATION OF A PRODUCTION STRING OF A WELL

(71) Applicant: PCM Technologies, Levallois-Perret (FR)

(72) Inventors: Francois Millet, Antony (FR); Stephen Burrows, La Chapelle sur Erdre (FR)

(73) Assignee: PCM TECHNOLOGIES, Lavallois Perret (FR)

( * ) Notice: Subject to any disclaimer, the term of this patent is extended or adjusted under 35 U.S.C. 154(b) by 208 days.

(21) Appl. No.: 14/551,793

(22) Filed: Nov. 24, 2014

(65) Prior Publication Data

US 2015/0144327 A1 May 28, 2015

(30) Foreign Application Priority Data

Nov. 26, 2013 (FR) ..... 13 61651

(51) Int. Cl.
*E21B 23/01* (2006.01)
*E21B 17/10* (2006.01)
*E21B 43/12* (2006.01)

(52) U.S. Cl.
CPC ..... *E21B 17/1071* (2013.01); *E21B 17/1057* (2013.01); *E21B 23/01* (2013.01); *E21B 43/126* (2013.01)

(58) Field of Classification Search
CPC .. E21B 23/01; E21B 17/1057; E21B 17/1071; E21B 43/126
See application file for complete search history.

(56) References Cited

U.S. PATENT DOCUMENTS 3,808,697 A * 5/1974 Hall ..... G01C 9/00 33/312
4,190,119 A * 2/1980 Loftis ..... E21B 19/24 173/140
6,062,309 A 5/2000 Gosse
6,155,346 A 12/2000 Aldridge
6,318,459 B1 11/2001 Wright et al.
(Continued)

FOREIGN PATENT DOCUMENTS

EP 1371810 A1 12/2003

OTHER PUBLICATIONS

French National Institute of Industrial Property (INPI), French Preliminary Search Report issued in corresponding French Application No. FR1361651, Jun. 24, 2014.

*Primary Examiner* — David Andrews
*Assistant Examiner* — Kristyn Hall
(74) *Attorney, Agent, or Firm* — Patzik, Frank & Samotny Ltd.

(57) ABSTRACT

A torque anchor intended to block the rotation of a production string with respect to a casing of a well, the torque anchor comprising a body, at least two supports mobile with respect to the body, wheels borne by the supports, the wheels being suitable for running on an inner face of said casing, at least one restraining device suitable for exerting a force on said wheels in order to anchor said wheels in said casing. Each restraining device comprises a set of springs suitable for acting on the set of said supports and a guide capable of guiding said set of springs; said guide being borne by said supports; said guide being mobile with respect to at least one support.

22 Claims, 3 Drawing Sheets

(56) References Cited

U.S. PATENT DOCUMENTS

| | | | | |
|---|---|---|---|---|
| 2004/0011533 | A1* | 1/2004 | Lawrence | E21B 23/01 166/382 |
| 2005/0098353 | A1* | 5/2005 | Maxwell | E21B 17/1057 175/57 |
| 2005/0139361 | A1 | 6/2005 | Aldridge et al. | |
| 2012/0211220 | A1 | 8/2012 | Ghazi-Moradi et al. | |
| 2016/0130895 | A1* | 5/2016 | Sonar | E21B 23/01 175/230 |

* cited by examiner

TORQUE ANCHOR FOR BLOCKING THE ROTATION OF A PRODUCTION STRING OF A WELL

RELATED APPLICATIONS

This invention claims priority to French patent application No. FR 13/61651 filed Nov. 26, 2013 the entirety of which is hereby incorporated by reference.

FIELD OF THE INVENTION

The invention relates to a torque anchor for blocking the rotation of a production string with respect to a casing (also called retaining housing) of a well and/or of a pumping installation equipped with a progressing cavity pump comprising such a torque anchor.

BACKGROUND OF THE INVENTION

In its most widespread configuration, a pumping installation comprises a wellhead equipped with a surface bearing drive mounted on a "blowout preventer" remotely driving a progressing cavity pump mounted at the base of a production string or inserted into the production string. The pump is installed downhole. The bearing drive, at the wellhead, supports and drives in rotation a drive shaft called a "polished rod". The polished rod drives a drill string (or a continuous pipe) located inside and throughout the length of the production string. This drill string in turn drives in rotation the rotor of the progressing cavity pump situated downhole. The fluid, situated downhole, is transferred through the pump and delivered into the production string up to the wellhead, from where it is evacuated by distribution pipes. The torque anchor holds the stator of the pump in such a way that it is not itself driven in rotation downhole and thus prevents the disconnection of the tubing forming the production string.

Torque anchors are known, in particular from the document U.S. Pat. No. 6,155,346 for a pumping installation, comprising teeth mounted on a cam, fixed to the tubing string. The teeth are suitable for being moved, via the cam, between a retracted position within the torque anchor and a blocking position in which the teeth extend radially outside the body of the torque anchor and grip the casing.

Such torque anchors have numerous disadvantages.

Firstly, they are based on interference techniques, and are therefore likely to become dislodged during production due to the strong vibrations generated by the progressing cavity pump. This dislodging can lead to the tubing string becoming unscrewed and falling downhole, involving a complete shutdown of the production operations and a significant cost for carrying out fishing operations.

Then, in certain cases, the retraction mechanism can become clogged due to the presence of sand, or be degraded by corrosion. In this case, the torque anchor is raised by force so that the casing and the downhole equipment are damaged.

Furthermore, the teeth are brought into blocking position by the rotation of the tubing string from the surface, carried out by operators using grip wrenches. This driving operation presents a certain risk to the safety of the operators handling the grip wrenches in order to impart a torsional stress. In fact, when the grip wrench slips, it can injure the operators.

Moreover, in normal operation, the interference of the teeth in principle leads to extremely high contact pressures between said teeth and the casing. Thus, given the high level of vibration during pumping, it is strongly suspected that the teeth, the form of which is necessarily aggressive in order to initiate interference, "machine" the casing.

Moreover, certain wells are subjected to significant variations in temperature during production. These temperature variations expand the tubing string which can be extended by a length of up to 6 metres, but do not expand, or only slightly expand, the casing since this is cemented to the formation. During these temperature variations, the torque anchor, pushed by the expansion of the production string, is displaced relative to the casing along the longitudinal axis of the well. As the teeth of the torque anchor are still anchored in the casing, definite damage caused by notching of the inner wall of the casing is suspected but has thus far not been quantified.

Finally, in order to be sure that the teeth of the torque anchor are firmly gripping the casing, they can be driven into blocking position at the surface of the well before the torque anchor is lowered downhole. In this case, the casing pipe assembly is cut and damaged during the descent of the torque anchor downhole.

The document EP 1 371 810 describes an anti-rotation device for a drilling rig of the type comprising a rotatable shaft and a housing containing the rotatable shaft. The anti-rotation device is suited to blocking the rotation of the housing in the wellbore. It comprises carriages provided with rollers mounted on a shaft perpendicular to the longitudinal axis of the housing. The edge of the roller is tapered so as to engage the rock of the wellbore and, by means of this engagement, to prevent any rotation of the drilling rig.

However, this anti-rotation device is not suitable for use in a casing as the tapered surface of the rollers risks cutting and damaging the casing. Furthermore, this device is undersized with respect to the torsional stresses applied by a stator to the production string, when the rotor is driven in rotation. Such a device could only counter such stresses by increasing its size in such a way that it could no longer be inserted into the production string.

SUMMARY OF THE INVENTION

The purpose of the present invention is to propose a torque anchor capable of withstanding high torsion torques.

Such high torques occur in wells pumping heavy hydrocarbons (presence of sand, aromatic oils, high viscosities) or water, in particular when using metal stators (those of metal/metal pumps of the PCM Vulcain™ type), high-throughput progressing cavity pumps, or when the pumping is carried out under particular operating conditions in which vibration stresses are significant or at temperatures that may reach 350° C.

To this end, a subject of the invention is a torque anchor intended to block the rotation of a production string with respect to a casing of a well having a longitudinal axis; the torque anchor comprising:

- a body having a longitudinal axis extending parallel to the longitudinal axis of the well, when the torque anchor is installed in the casing;
- at least two supports borne by the body and mobile with respect to the body in at least one direction of displacement perpendicular to the longitudinal axis of the body;
- wheels borne by the supports, the wheels being suitable for running on an inner face of said casing;
- at least one restraining device suitable for exerting a force on said wheels in said at least one direction of displacement in order to anchor said wheels in said casing, characterized in that each restraining device comprises a set of springs suitable for acting on the set of said supports and a guide capable of guiding said set of springs; said guide being borne by said supports; said guide being mobile with respect to at least one support in said at least one direction of displacement.

Advantageously, this arrangement makes it possible to use longer and broader springs which are not very sensitive to temperature variations and variations in the diameter of the casing. Thus, the performance of the torque anchor is more stable. The torques applied by the torque anchor are more constant. They vary little as a function of the temperature and of the level of deterioration of the casing. Moreover, these springs of larger size can apply a significant force.

According to particular embodiments, the torque anchor comprises one or more of the following features:

the body has an inner channel suitable for allowing the passage of a fluid to be pumped; said inner channel, open at each of its ends, extends parallel to the longitudinal axis of the body, and said restraining device extends through said inner channel.

Advantageously, the inner channel makes it possible to pump a larger quantity of fluid. It makes it possible to reduce the pressure drop caused by the torque anchor in the casing in circumstances in which the pumped fluid travels the length of the torque anchor, between the torque anchor and the casing, before reaching the intake port of the pump.

the set of springs comprises at least one spring supported on each support, said guide being suitable for guiding said at least one spring.

the supports comprise a first support and a second support arranged facing the first support, the first and second supports being mobile with respect to the body in a single direction of displacement.

at least one support chosen from the first support and second support comprises at least one through hole extending in the direction of displacement, and in which the guide is a guide pin having one end fitted sliding in said through hole in said chosen support.

Advantageously, said guide pin and said at least one spring can be easily removed.

the guide pin comprises a first shoulder and a second shoulder, the second shoulder being arranged in line with the first shoulder, the first shoulder abutting said first support, said at least one spring supported against said second shoulder.

Advantageously, this arrangement makes it possible to avoid the loss of the guide pin in the well.

Advantageously, said wheel spindle and said at least one spring are held against said first support during the withdrawal of the torque anchor from the casing. Thus, said at least one spring can easily be removed and changed, during a maintenance operation.

said at least one spring is supported on both the first support and the second support.

said guide comprises an intermediate joint and guide pins, said guide pins each having one end firmly fixed to said intermediate joint and one free end guided in translation in a support; each spring being supported on said intermediate joint and a support.

said set of springs comprising at least N springs, said guide comprising N guide pins; said guide being mobile with respect to the N supports in N directions with N a natural number strictly greater than two.

the supports are suitable for bearing several adjacent wheels aligned with each other, said wheels each having a diameter comprised between 12% and 70% and, preferably, comprised between 30% and 48% of the inner diameter of the casing.

Advantageously, such a torque anchor is capable of passing without jerking, and without the risk of jamming, through the joints arranged between the tubes forming the casing.

said support is suitable for bearing a single wheel having a diameter comprised between 30% and 70%, and preferably comprised between 30% and 48% of the inner diameter of the casing.

Advantageously, such a torque anchor has a reduced dimension in the direction of the longitudinal axis, while allowing easy passage through the joints arranged between the tubes forming the casing.

the torque anchor also comprises wheel spindles mounted freely rotatable on said wheels, and in which the supports have at least one rotational guide surface of said wheel spindles.

Thus, advantageously, the wheel is mounted on the wheel spindle without a fixing part, thus improving the reliability of the system and thus avoiding any risk of loss of components in the well provided that the coefficients of expansion of the materials in contact are identical, or sufficiently close for the differential expansion to be negligible. Advantageously, this mounting does not present any risk of loss of components since the spindle is captive in the opening receiving the wheel support.

the restraining device is suitable for exerting on the inner wall of the casing a theoretical contact pressure calculated according to the Hertz formulae comprised between 2 and 20 times the elastic limit of the casing and preferably between 4 and 10 times the elastic limit of the casing.

the supports are formed from a single block provided with an opening suitable for accommodating at least a part of at least one wheel, and at least one through hole in which said end of the guide pin is arranged.

Advantageously, this support is simple to produce and robust, which ensures reliable operation of the torque anchor inserted into a production borehole or oil production well and resistant to the corrosive and abrasive environment of the pumped fluid.

the body comprises at least two apertures; each aperture accommodates a support capable of sliding in said aperture; and in which grease is interposed between each support and each aperture.

Thus advantageously, all of the parts contained in the first support can be freely and easily removed from the housing and changed during the torque anchor maintenance operations.

Sticking with grease makes it possible to lubricate the contact between the housing and the support while generating a slight resistance to the removal of the support when handling the torque anchor outside the casing.

BRIEF DESCRIPTION OF THE DRAWINGS

The invention will be better understood on reading the following description, given by way of example only and with reference to the figures in which.

DETAILED DESCRIPTION OF THE INVENTION

Figure 1:
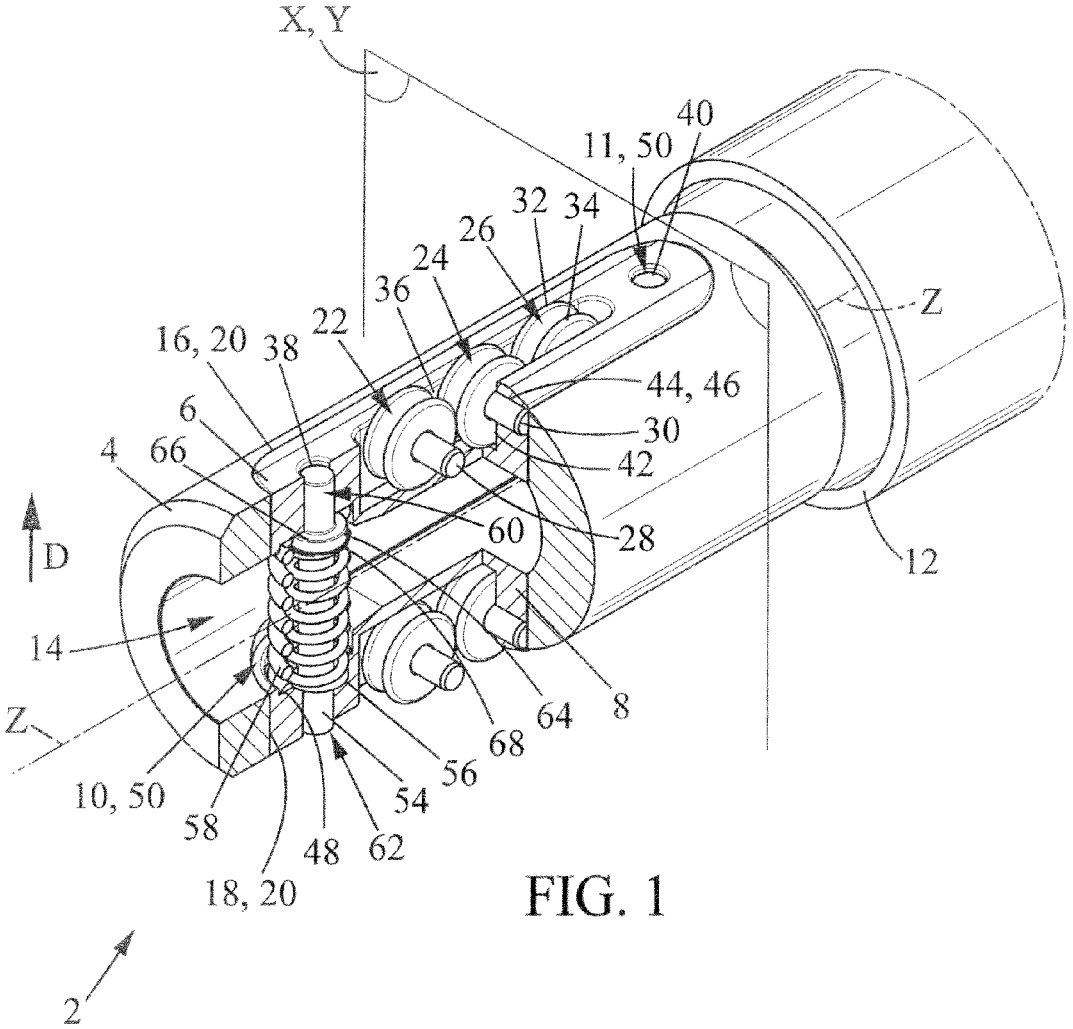
FIG. 1 is a cut-away perspective view of a torque anchor and a casing according to a first embodiment of the invention.

While this invention is susceptible of embodiment in many different forms, there is shown in the drawings and will herein be described in detail several specific embodiments, with the understanding that the present disclosure is to be considered merely an exemplification of the principles of the invention and the application is limited only to the appended claims.

The torque anchor according to the present invention is mainly intended to be installed in a casing of a hydrocarbons, water or gas pumping installation.

With reference to FIG. 1, the torque anchor 2 according to the first embodiment of the invention comprises a body 4, for example, having a generally cylindrical shape, a first 6 and a second 8 support borne by the body 4, and a first 10 and a second 11 restraining device, both suitable for acting between the first 6 and second 8 supports.

The body 4 has a longitudinal axis Z-Z which extends parallel to the longitudinal axis of the well, when the torque anchor 2 is installed in the casing 12 of the well. It is provided with an inner channel 14 open at each end, as well as a first 16 and a second 18 apertures which open both onto the inner channel 14 and onto the outer face of the body 4.

The inner channel 14 extends in the direction of the longitudinal axis Z-Z. It is suitable for allowing the passage of a fluid to be pumped, thus increasing the pumping capacity of the pumping installation to which the torque anchor 2 is fixed. This inner channel 14 reduces the pressure drop caused by the torque anchor 2 in the casing 12 in circumstances in which the pumped fluid passes between the torque anchor 2 and the casing 12 before reaching the intake port of the progressing cavity pump.

The first 16 and second 18 apertures extend facing each other, perpendicularly to the longitudinal axis Z-Z. They are suitable for accommodating, one, the first support 6, and the other, the second support 8. Thus, the first 6 and second 8 supports are arranged facing one another, in the same mid-plane (X, Y).

The first 16 and second 18 apertures have smooth inner faces 20 on which the first 6 and second 8 supports can slide, under the action of the first 10 and second 11 restraining devices, in a direction perpendicular to the longitudinal axis Z-Z, called direction of displacement D.

Preferably, grease is arranged at the interface between the first support 6 and the first aperture 16, and between the second support 8 and the second aperture 18 to lubricate their contacts while generating a slight resistance to the extraction of the first 6 and second 8 supports, during maintenance of the torque anchor 2 outside the casing 12.

The first 6 and second 8 supports are identical. Only the first support 6 will be described in detail.

The first support 6 is suitable for bearing a set of three wheels 22, 24, 26 intended to run the length of the casing 12, for example, during the descent of the torque anchor 2 downhole.

The three wheels 22, 24, 26 are aligned one behind another, parallel to the longitudinal axis Z-Z. The gap between two adjacent wheels is advantageously comprised between 101% and 105% of the diameter of said wheels.

The three wheels 22, 24, 26 preferably have the same diameter. For example, a diameter comprised between 12% and 48% of the inner diameter of the casing 12.

The positioning of the wheels 22, 24, 26 as well as their diameter allow the set of three wheels 22, 24, 26 to pass through the joints arranged between the tubes forming the casing 12 without becoming jammed in the discontinuity of the joint and without damaging these joints. They also allow passage through the joints without jerking.

The wheels 22, 24, 26 are each mounted freely rotatable on a wheel spindle 28, 30. The wheel spindles 28, 30 have a direction perpendicular to the direction of displacement D and perpendicular to the longitudinal axis Z-Z. They are mounted freely rotatable on the first support 6 so that there is redundancy at the level of the rotational guide of the wheels 22, 24, 26 with respect to the support 6. This redundancy limits the risk of jamming of a wheel by seizing of the wheel spindle 28, 30 either onto the wheel 22, 24, 26, or onto the first support 6. The wheel spindles 28, 30 are held axially by cooperation between the inner faces 20 of the first aperture 16 with the ends of the wheel spindles 28, 30. Advantageously, this mounting simplifies both the production and maintenance of the product.

Advantageously, in order to limit the risks of seizing of the guide of the wheels 22, 24, 26, the wheel spindles 28, 30 are produced from ceramics of the zirconium or zirconium oxide (ZrO2) type, machining materials that are resistant to corrosion, shear, seizing and bending, as well as having remarkable resilience including at high temperatures.

Two flanges 32, 34 forming an open toroid portion are produced on the two lateral edges of the circular periphery of each wheel 22, 24, 26. The flanges 32, 34 are intended to anchor themselves in the casing 12 by controlled indentation, under the action of the first 10 and second 11 restraining devices, in order to transmit a torque to the casing 12. Such a torque is generated, for example, by the rotation of the rotor of a progressing cavity pump.

Advantageously, the flanges 32, 34 are provided with a coating increasing both their wear resistance and their coefficient of friction with the casing 12. This coating is, for example, produced based on tungsten carbide or synthetic diamond.

Advantageously, the two flanges 32, 34 arranged on the two lateral edges of the circular periphery of each wheel 22, 24, 26 make it possible to double the points of contact with the casing 12—given a number of wheels that remains the same—and thus to have a greater surface area in contact with the torque anchor 2 in the well, for example during its descent, its ascent, and on variations in the length of the production tube under the effect of expansion. In fact, this construction arrangement minimizes the contact pressure between the wheel and the casing calculated according to the Hertz formulae.

This arrangement of the flanges 32, 34 at the two edges of the circular periphery of each wheel 22, 24, 26 also makes it possible to minimize the bending moment in the wheel spindles 28, 30.

As a variant, the end surfaces of the wheels 22, 24, 26 which cooperate with the inner lateral walls 42 of the support 6 are carbide-coated in order to improve the service life of said wheels 22, 24, 26 and, as a result, the service life of the torque anchor 2.

The first support 6 is produced in a single piece. It is equipped with an oblong opening 36 open outwards, which extends parallel to the longitudinal axis Z-Z and with two through holes 38, 40 aligned with the opening 36, one placed on one side of one end of the opening 36 and the other on the other side of the opposite end of the opening 36.

The inner lateral walls 42 of the opening 36 are each provided with three circular bores 44, each receiving one end of a wheel spindle 28, 30. The inner faces 46 of said bores 44 guide the wheel spindles 28, 30 in rotation.

The through holes 38, 40 of the first support 6 receive and guide in translation, one, the first restraining device 10 and the other, the second restraining device 11. They extend in the direction of displacement D. A recess 48 is formed around each through hole 38, 40, on the face of the first support 6 arranged toward the inner channel 14.

The first 10 and second 11 restraining devices are arranged on either side of the set of three wheels 22, 24, 26. They are identical. Only the first restraining device 10 will be described in detail.

The first restraining device 10 is suitable for distancing the first support 6 from the second support 8 in order to anchor said wheels 22, 24, 26 in said casing 12, when the torque anchor 2 is arranged in the casing 12.

In particular, the restraining device 10 is suitable for exerting on the inner wall of the casing 12 a theoretical contact pressure calculated according to the Hertz formulae comprised between 2 and 20 times the elastic limit of the casing 12 and preferably between 4 and 10 times the elastic limit of the casing 12.

The first restraining device 10 comprises a set of springs 50 and a guide 54 suitable for guiding said set of springs 50.

The set of springs 50 comprises an inner helical spring 56 and an outer helical spring 58.

In this embodiment, the guide is a guide pin 54 which extends in the direction of displacement D. The inner helical spring 56 and the outer helical spring 58 are mounted coaxially, one inside the other, on the guide pin 54.

The guide pin 54, the first spring 56 and the second spring 58 pass through the inner channel 14, from one side to the other, following a line passing through a point of the longitudinal axis Z-Z. The fluid which will be pumped by the progressing cavity pump is suitable for ascent within the inner channel 14 in a space delimited between the set of springs 50 and the inner face of the body 4 delimiting the inner channel 14.

The guide pin 54 is borne by the first support 6 and the second support 8. In particular, one end 60 of the guide pin is mounted sliding in the through hole 38 in the first support 6 and the opposite end 62 of the guide pin is mounted sliding in the through hole 38 in the second support 8. According to the embodiment shown, the ends 60 and 62 are journals.

As a variant, the ends 60 and 62 are spherical and suitable for engagement in a through hole 38 so as to produce a round joint.

As a variant, the guide pin 54 is fixed to the first support and is mobile in the direction of displacement D only with respect to the second support 8.

The guide pin 54 also comprises a ring 64 having a first shoulder 66 abutting the base of the recess 48 of the first support and a second shoulder 68 arranged in line with the first shoulder 66, on which one end of the inner spring 56 is supported. The other end of the inner spring 56 abuts the base of the recess 48 of the second support 8.

Advantageously, this arrangement makes it possible to avoid the loss of the guide pin 54 in the well. This arrangement also allows easy extraction of the first restraining device 10, when the torque anchor 2 is withdrawn from the casing 12 as the first restraining device is held against the first support 6 and will be withdrawn therewith.

The outer spring 58 is itself advantageously supported on the one hand, against the base of the recess 48 of the first support 6 and on the other hand, against the base of the recess 48 of the second support 8.

Advantageously, the inner spring 56 and the outer spring 58 are coiled in opposite directions. Preferably, the inner spring 56 and the outer spring 58 are nested springs.

As a variant, the wheels 22, 24, 26 are each mounted firmly fixed to a wheel spindle 28, 30. In particular, the wheel spindles 28, 30 are flush-mounted on said wheels 22, 24, 26 and, preferably, shrink-fitted to said wheels 22, 24, 26.

As a variant, the set of wheels comprises N wheels, with N a natural number greater than one.

As a variant, the inner spring 56 and the outer spring 58 are coiled wave springs.

As a variant, the set of springs 50 comprises a single spring.

As a variant, the torque anchor 2 comprises a single restraining device 10. In this case, the restraining device 10 is arranged, at the centre, between two times N wheels, with N being a natural number greater than or equal to one.

According to a first variant, the wheels 22, 24, 26 are alternately offset.

According to a second variant, the wheels 22, 24, 26 are conical.

According to a third variant, the wheels 22, 24, 26 are provided alternately, at least one, with a flange situated at the centre of the circular periphery, and at least one other, with two flanges situated at the edges of the circular periphery.

If the torque anchor according to the present invention is produced according to one of these three aforementioned variants, the outer diameter of the flanges of the three wheels 22, 24, 26 is a diameter comprised between 15% and 70% of the inner diameter of the casing 12.

Figure 2:
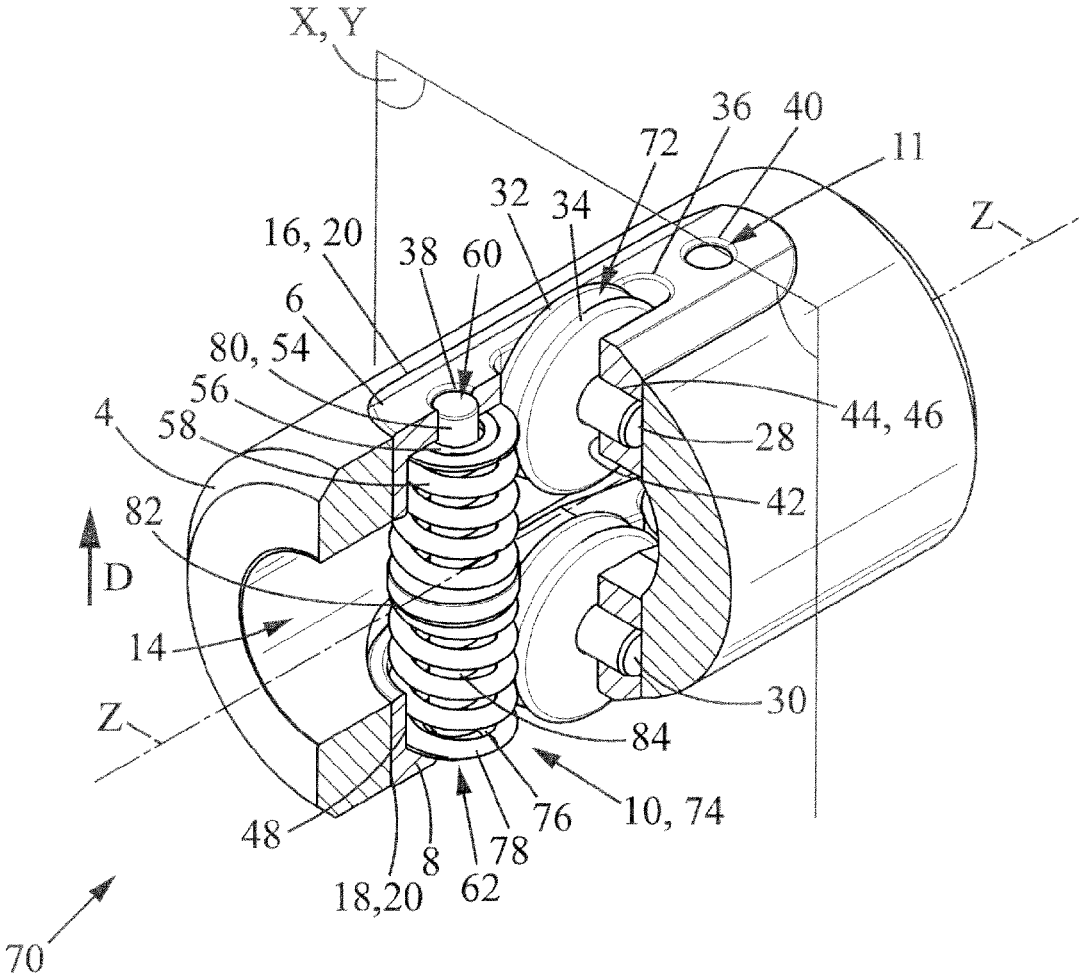
FIG. 2 is a cut-away perspective view of a torque anchor according to a second embodiment of the invention.

The torque anchor 70 according to the second embodiment is shown in FIG. 2. The technical elements of the torque anchor 70 according to the second embodiment that are identical or similar to the technical elements of the torque anchor 2 according to the first embodiment are identified by the same reference numbers and will not be described a second time.

In particular, the torque anchor 70 according to the second embodiment of the invention is similar to the torque anchor 2 according to the first embodiment, with the exception of the following features.

The three wheels 22, 24, 26 have been replaced by a single wheel 72 having a larger diameter.

Thus, in this embodiment, the first 6 and second 8 supports are each suitable for bearing a single wheel 72 having a diameter comprised between 30% and 48% of the inner diameter of the casing 12.

In the same way as for the first embodiment, the diameter of the wheel 72 can be comprised between 30% and 70% if the wheel 72 is either conical or also provided with a central flange or two edge flanges.

The first restraining device 10 extends through the inner channel 14. It comprises a set of springs 74 and a guide 80 suitable for bearing the set of springs.

The set of springs 74 comprises, in this embodiment, two inner springs 56, 76 and two outer springs 58, 78.

The guide 80 is mobile with respect to the first support 6 and the second support 8 in the direction of displacement D. It comprises an intermediate joint 82 in the form of a ring, a first guide pin 54 and a second guide pin 84. The first 54 and second 84 guide pins are concentric. Each has one end firmly fixed to the intermediate joint 82 and one free end. The free end of the first guide pin 54 is mounted sliding in the through hole 38 in the first support 6. The free end of the second guide pin 84 is mounted sliding in the through hole 38 in the second support 8.

An inner spring 56 and an outer spring 58 are arranged coaxially with the first guide pin 54. They are supported, on the one hand, on the first support 6 and, on the other hand, on the intermediate joint 82. The other inner spring 76 and the other outer spring 78 are arranged coaxially with the second guide pin 84. They are supported, on the one hand, on the second support 8 and, on the other hand, on the intermediate joint 82.

The stiffness of the inner spring 56 and outer spring 58 mounted on the first guide pin 54 is identical to the stiffness of the inner spring 76 and outer spring 78 mounted on the second guide pin 84. Thus, the forces exerted by these springs are in mutual opposition and compensate for each other.

In practice, the guide 80 can be produced by fixing a ring at mid-height of a single pin.

Figure 3:
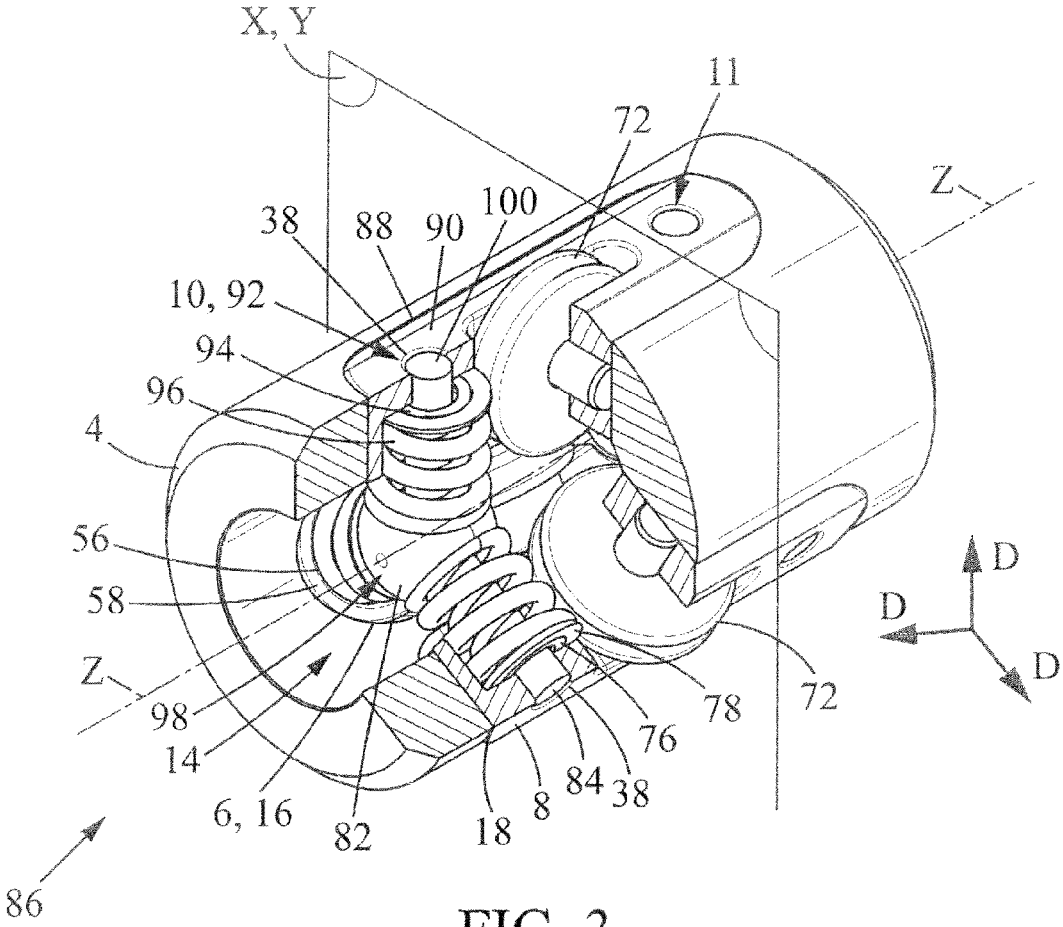
FIG. 3 is a cut-away perspective view of a torque anchor according to a third embodiment of the invention.
Figure 4:
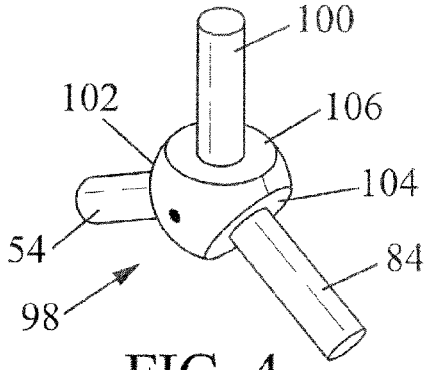
FIG. 4 is a perspective view of a torque anchor guide according to the third embodiment of the invention.

The torque anchor according to the third embodiment is shown in FIGS. 3 and 4. The technical elements of the torque anchor 86 according to the third embodiment that are identical or similar to the technical elements of the torque anchor 2 according to the first embodiment are identified by the same reference numbers and will not be described a second time.

In particular, the torque anchor 86 according to the third embodiment of the invention is similar to the torque anchor 70 according to the second embodiment with the exception of the following features.

The body 4 of the torque anchor 86 according to the third embodiment of the invention comprises a first 16, a second 18 and a third 88 aperture preferably regularly distributed equiangularly around the peripheral edge of the body 4. The first 16, second 18 and third 88 apertures accommodate a first 6, a second 8 and a third 90 support situated in the same mid-plane (X, Y). The first 6, second 8 and third 90 supports are similar to the first 6 and second 8 supports described in relation to the first embodiment of the invention.

The first restraining device 10 and the second restraining device 11 of the torque anchor 86 according to the third embodiment of the invention are identical. Only the first restraining device 10 is described in detail.

The first restraining device 10 is constituted by a set of springs 92 suitable for acting between the first 6, second 8 and third 90 supports, and a guide 98 suitable for guiding the set of springs 92.

The set of springs 92 comprises three inner helical springs 56, 76, 94, and three outer helical springs 58, 78, 96.

The guide 98 is mobile with respect to the three supports 6, 8, 90 in three directions of displacement D.

With reference to FIG. 4, the guide 98 comprises an intermediate joint 82, a z first guide pin 54, a second guide pin 84, and a third guide pin 100 each having one end fixed to the intermediate joint 82.

The first 54, second 84 and third 100 guide pins extend in a plane perpendicular to the longitudinal axis Z-Z, said plane passing through the through hole 38 in each support. They are, for example, distributed equiangularly in this plane. The free ends of the first 54, second 84, and third 100 guide pins are each mounted sliding in a through hole 38 in the first 6, second 8 and third 90 supports respectively.

An inner spring 58 and an outer spring 56 are arranged one inside the other and coaxially with the first guide pin 54. They are supported on the first support 6 and on a planar surface 102 of the intermediate joint 82.

Similarly, an inner spring 76 and an outer spring 78 are arranged one inside the other and coaxially with the second guide pin 84. They are supported on the second support 8 and on another planar surface 104 of the intermediate joint 82. Finally, an inner spring 94 and an outer spring 96 are arranged one inside the other and coaxially with the third guide pin 100. They are supported on the third support 90 and on a last planar surface 106 of the intermediate joint 82.

The stiffness of the inner springs and of the outer springs mounted on each guide pin are equal so that the forces exerted by the springs are in mutual opposition and compensate for each other.

The restraining device 10 of the torque anchor 86 according to the third embodiment of the invention also extends through the inner channel 14. This restraining device 10 makes it possible to apply a greater torque that is better distributed as it is distributed over three points. This restraining device 10 is more bulky than the restraining devices 10 of the first and second embodiments, but nevertheless it allows fluid to pass in the inner channel 14.

Just as for the first embodiment, the set of springs 92 comprises, as a variant, a single spring or more than two springs. It comprises, as a variant, coiled wave springs.

As a variant, in the same way as for the first embodiment, the torque anchor 86 according to the third embodiment comprises a single restraining device arranged between two times N wheels with N a natural integer, or two times N restraining devices arranged on either side of a single wheel or of several wheels having a smaller diameter.

As a variant, in the same way as for the first embodiment, the ends of the first 54, second 84 and third 100 guide pins are spherical.

The torque anchor 2, 70, 86 according to the invention is preferably fixed downstream of a perforated liner with respect to the direction of pumping.

As a variant, the torque anchor 2, 70, 86 comprises N restraining devices 10, 11, with N a natural integer greater than or equal to four; the number N being chosen as a function of the force that it is desired to apply to said wheels.

As a variant, the wheel 72 of the torque anchor according to the second and third embodiments is replaced by a set of wheels.

According to a variant (not shown), a sieve or grille is fixed to the intake of the inner channel 14 in order to filter out clumps of earth or sand which could damage the restraining device.

According to a variant (not shown), a cylindrical guard is fixed around each restraining device 10, 11 in order to protect the springs from clumps of earth or sand.

The invention claimed is:

1. A torque anchor intended to block the rotation of a production string with respect to a casing of a well having a longitudinal axis, the torque anchor comprising:

a body having a longitudinal axis extending parallel to the longitudinal axis of the well, when the torque anchor is installed in the casing;

at least two supports borne by the body and mobile with respect to the body in at least one direction of displacement perpendicular to the longitudinal axis of the body, the at least two supports comprise a first support and a second support arranged facing the first support, the first and second supports being mobile with respect to the body in a single direction of displacement;

wheels borne by the supports, the wheels being suitable for running on an inner face of said casing;

at least one restraining device suitable for exerting a force on said wheels in said at least one direction of displacement in order to anchor said wheels in said casing, wherein each restraining device comprises a set of springs suitable for acting on the at least two supports and a guide capable of guiding said set of springs; said set of springs comprising at least one spring supported on each of said at least two supports; said guide being borne by said supports, and mobile with respect to at least one of the supports in said at least one direction of displacement, said guide being suitable for guiding the at least one spring and comprising at least one guide pin arranged in at least one part of the least one spring.

2. The torque anchor according to claim 1, in which at least one support chosen from the first support and the second support comprises at least one through hole extending in the direction of displacement, and in which the guide pin has one end mounted sliding in said through hole in said chosen support.

3. The torque anchor according to claim 2, in which the guide pin comprises a first shoulder and a second shoulder, the second shoulder being arranged in line with the first shoulder, the first shoulder abutting said first support, said at least one spring being supported against said second shoulder.

4. A torque anchor intended to block the rotation of a production string with respect to a casing of a well having a longitudinal axis; the torque anchor comprising:

a body having a longitudinal axis extending parallel to the longitudinal axis of the well, when the torque anchor is installed in the casing;

at least two supports borne by the body and mobile with respect to the body in at least one direction of displacement perpendicular to the longitudinal axis of the body;

wheels borne by the supports, the wheels being suitable for running on an inner face of said casing;

at least one restraining device suitable for exerting a force on said wheels in said at least one direction of displacement in order to anchor said wheels in said casing;

wherein each restraining device comprises a set of springs suitable for acting on the at least two supports and a guide capable of guiding said set of springs; said set of springs comprising at least one spring supported on each of said at least two supports; said guide being borne by said supports; said guide being suitable for guiding said at least one spring; said guide being mobile with respect to at least one of the supports in said at least one direction of displacement;

wherein the supports comprise a first support and a second support arranged facing the first support, the first and second supports being mobile with respect to the body in a single direction of displacement; said at least one spring being supported on both the first support and the second support.

5. The torque anchor according to claim 4, in which the body has an inner channel suitable for allowing the passage of a fluid to be pumped;

in which said inner channel, open at each of its ends, extends parallel to the longitudinal axis of the body, and in which said restraining device extends through said inner channel. spring being supported against said second shoulder.

6. The torque anchor according to claim 5, in which the at least two supports are formed in a single piece provided with an opening suitable for accommodating at least a part of at least one wheel, and with at least one through hole in which said end of the guide pin is arranged.

7. The torque anchor according to claim 4, in which the casing has an inner diameter and the at least two supports are suitable for bearing several adjacent wheels aligned with respect to each other, said wheels each having a diameter comprised between 12% and 70% of the inner diameter of the casing.

8. The torque anchor according to claim 7, in which the casing has an inner diameter and said wheels each have a diameter comprised between 30% and 48% of the inner diameter of the casing.

9. The torque anchor according to claim 4, in which the casing has an inner diameter and each of said at least two supports is suitable for bearing a single wheel having a diameter comprised between 30% and 70% of the inner diameter of the casing.

10. The torque anchor according to claim 4 , also comprising wheel spindles mounted freely rotatable on said wheels, and in which the at least two supports have at least one rotational guide surface of said wheel spindles.

11. The torque anchor according to claim 4, in which the casing has an inner wall and an elastic limit, and the restraining device is suitable for exerting on the inner wall of the casing a theoretical contact pressure calculated according to the Hertz formulae, comprised between 2 and 20 times the elastic limit of the casing.

12. The torque anchor according to claim 4, in which the body comprises at least two apertures; each aperture receiving a support capable of sliding in said aperture and in which grease is interposed between each support and each aperture.

13. A torque anchor intended to block the rotation of a production string with respect to a casing of a well having a longitudinal axis; the torque anchor comprising:

a body having a longitudinal axis extending parallel to the longitudinal axis of the well, when the torque anchor is installed in the casing;

at least two supports borne by the body and mobile with respect to the body in at least one direction of displacement perpendicular to the longitudinal axis of the body;

wheels borne by the supports, the wheels being suitable for running on an inner face of said casing;

at least one restraining device suitable for exerting a force on said wheels in said at least one direction of displacement in order to anchor said wheels in said casing;

wherein each restraining device comprises a set of springs suitable for acting on the at least two supports and a guide capable of guiding said set of springs; the set of springs comprising at least one spring supported on each support; said guide being borne by said supports; said guide being suitable for guiding said at least one spring; said guide being mobile with respect to at least one of the supports in said at least one direction of displacement; and wherein said guide comprises an intermediate joint and guide pins, said guide pins each having one end firmly fixed to said intermediate joint and one free end guided in translation in one of the at least two supports; each spring being supported on said intermediate joint and one of the at least two supports.

14. The torque anchor according to claim 13, comprising N supports, said set of springs comprising at least N springs, said guide comprising N guide pins, said guide being mobile with respect to the N supports in N directions with N a natural integer strictly greater than two.

15. The torque anchor according to 13, in which the body has an inner channel suitable for allowing the passage of a fluid to be pumped; in which said inner channel, open at each of its ends, extends parallel to the longitudinal axis of the body, and in which said restraining device extends through said inner channel.

16. The torque anchor according to claim 15, in which the at least two supports are formed in a single piece provided with an opening suitable for accommodating at least a part of at least one wheel, and with at least one through hole in which said end of the guide pin is arranged.

17. The torque anchor according to claim 13, in which the at least two supports comprise a first support and a second support arranged facing the first support, the first and second supports being mobile with respect to the body in a single direction of displacement.

18. The torque anchor according to claim 13, in which the casing has an inner diameter and the at least two supports are suitable for bearing several adjacent wheels aligned with respect to each other, said wheels each having a diameter comprised between 12% and 70% of the inner diameter of the casing.

19. The torque anchor according to claim 13, in which the casing has an inner diameter and each of said at least two supports is suitable for bearing a single wheel having a diameter comprised between 30% and 70% of the inner diameter of the casing.

20. The torque anchor according to claim 13, also comprising wheel spindles mounted freely rotatable on said wheels, and in which the at least two supports have at least one rotational guide surface of said wheel spindles.

21. The torque anchor according to claim 13, in which the casing has an inner wall and an elastic limit, and the restraining device is suitable for exerting on the inner wall of the casing a theoretical contact pressure calculated according to the Hertz formulae, comprised between 2 and 20 times the elastic limit of the casing.

22. The torque anchor according to claim 13, in which the body comprises at least two apertures; each aperture receiving a support capable of sliding in said aperture and in which grease is interposed between each support and each aperture.

* * * * *